US006213660B1

(12) United States Patent
Waller et al.

(10) Patent No.: US 6,213,660 B1
(45) Date of Patent: Apr. 10, 2001

(54) DUAL BRUSH SYSTEM

(76) Inventors: Scott Waller, 375 Bridgeport Ave., Shelton, CT (US) 06484; Elliott Dreznick, 6 Apricot, Mount Sinai, CT (US) 11766; Jeffrey Dreznick, 85 Old Stonewall Rd., Easton, CT (US) 06612

( * ) Notice: Subject to any disclaimer, the term of this patent is extended or adjusted under 35 U.S.C. 154(b) by 0 days.

(21) Appl. No.: 09/577,287

(22) Filed: May 23, 2000

(51) Int. Cl.[7] ..... A47L 1/68
(52) U.S. Cl. ..... 401/24; 401/18; 401/126
(58) Field of Search ..... 401/24, 18, 23, 401/39, 268, 269, 126, 16

(56) References Cited

U.S. PATENT DOCUMENTS 2,816,305 12/1957 Kravitt .
2,869,168 * 1/1959 Morneault ..... 401/18
2,964,045 * 12/1960 Otto et al. ..... 401/18
5,620,270 4/1997 Gueret .

* cited by examiner

*Primary Examiner*—David J. Walczak
(74) *Attorney, Agent, or Firm*—Collard & Roe, PC

(57) ABSTRACT

A dual brush system having a first brush system and a second brush system within the first brush system. The first brush system contains a cannulated rod with a cannulated cap attached at one end and a set of bristles at the opposite end. The second brush system contains a second cap attached to one end of a second rod and a second set of bristles is attached to the other end. The second rod fits into the cannulated rod so that the two sets of bristles align with one another. The first and second set of bristles can be used together or individually.

8 Claims, 3 Drawing Sheets

DUAL BRUSH SYSTEM

BACKGROUND OF THE INVENTION

1. Field of the Invention

The invention relates to a brush system having a larger brush that contains a smaller brush therein.

2. The Prior Art

When using a bottle of correction fluid, for example, it may be necessary to use a brush that has a smaller diameter than the brush provided for fine corrections. This is especially necessary when correcting technical drawings and diagrams.

U.S. Pat. No. 2,816,305 to Kravitt discloses a paint brush that contains a smaller brush within it. The smaller brush slides down through the handle of the larger brush by a button-screw mechanism. This connecting mechanism allows the smaller brush to slide out through the bristles of the larger brush. When not in use, the smaller brush retracts up into the middle of the larger bristles. Therefore, the brushes can be used together or the smaller brush can be used alone.

The disadvantage of this brush system is that the smaller brush can not be disconnected from the larger brush. Therefore, control of the brush is difficult due to the length of the brush arm.

U.S. Pat. No. 5,620,270 to Gueret discloses a device for storing and applying a makeup product. This invention consists of a first applicator that contains a hollow portion. A second applicator fits into the hollow portion of the first applicator. The walls of the first applicator contain at least one slot at the level of the brush of the second applicator so that the second brush can be used to apply the same substance in the container. Another embodiment of this invention shows the hollow portion of the first applicator containing a different substance so that the second brush can be used to apply another type of makeup.

The disadvantage of this system is that the two brushes can not be used together, and the user is limited to using one brush at a time.

SUMMARY OF THE INVENTION

The present invention overcomes these disadvantages by providing a dual brush system having a first brush system and a second brush system within the first brush system. The first brush system contains a cannulated rod with a cannulated cap attached at one end and a set of bristles at the opposite end. The second brush system contains a second cap attached to one end of a second rod and a second set of bristles attached to the other end. The second rod fits into the cannulated rod so that the two sets of bristles align with one another. The first and second set of bristles can be used together or individually.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
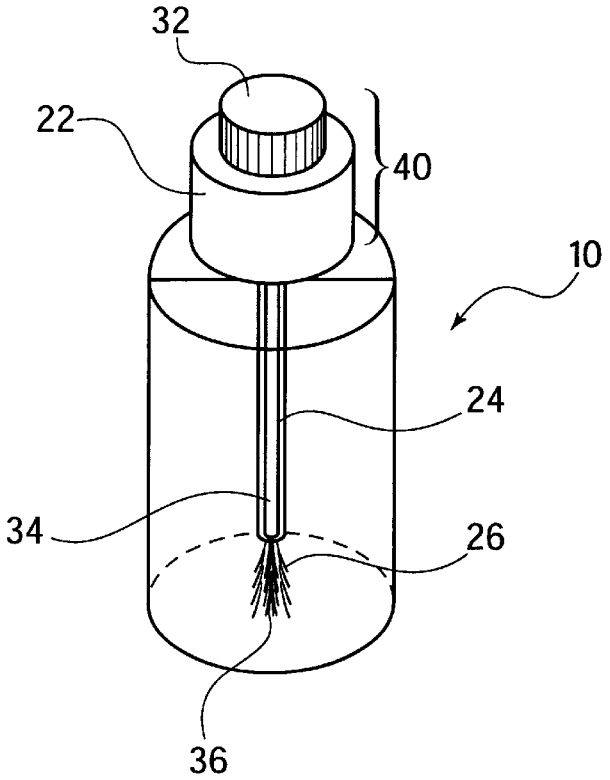
FIG. 1 shows a perspective view of a bottle having the dual brush system according to the invention.
Figure 2A:
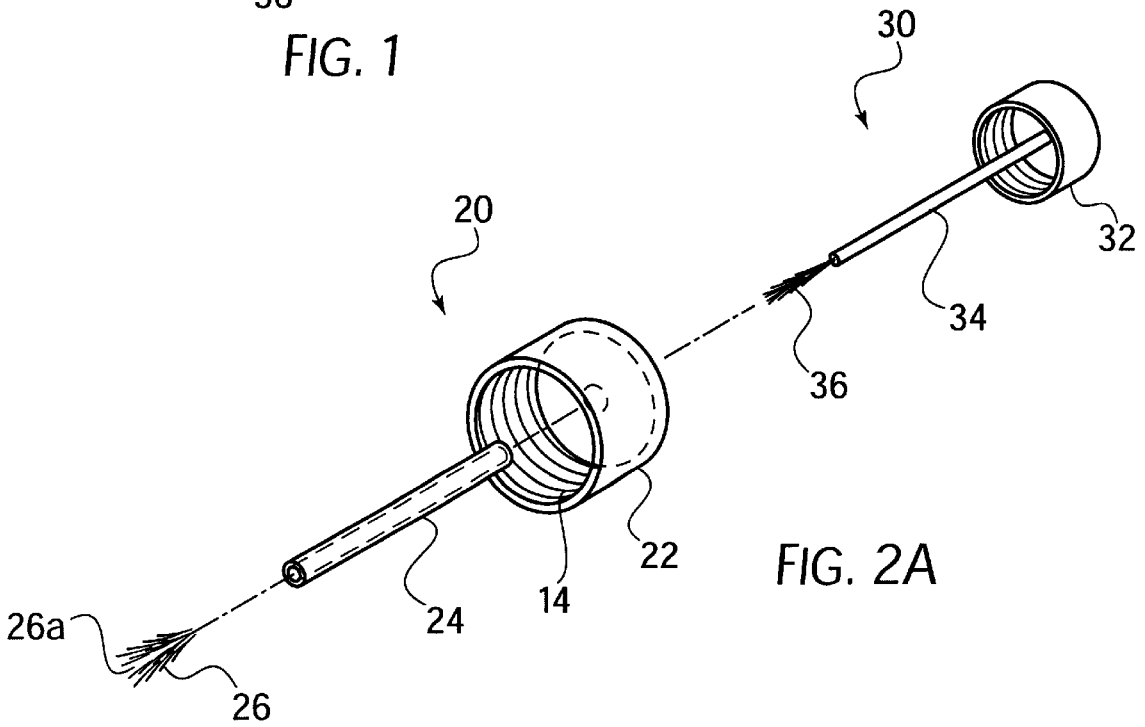
FIG. 2*a* shows an exploded view of the dual brush system.
Figure 2B:
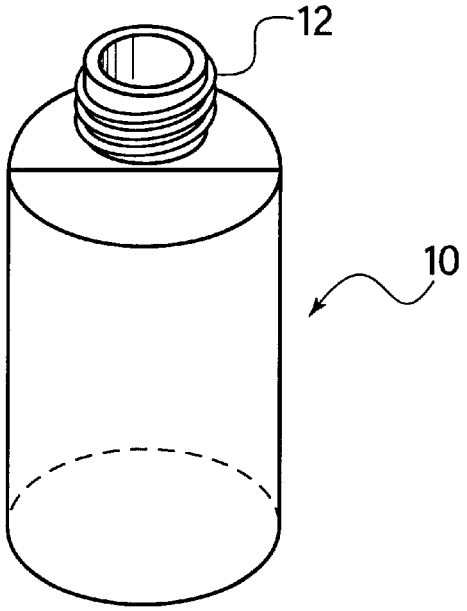
FIG. 2*b* shows a side perspective view of the bottle.

Referring now in detail to the drawings and, in particular in FIGS. 1, 2*a* and 2*b*, there is shown a bottle 10 having a dual brush system 40. Dual brush system 40 contains a first brush system 20 and a second brush system 30. First brush system 20 contains cannulated cap 22 connected to cannulated rod 24. A first set of bristles 26 attaches to cannulated rod 24 at the opposite end of cannulated cap 22. First set of bristles 26 contains a passageway into which second set of bristles 36 enters so that the two sets of bristles are aligned with one another.

Cannulated cap 22 contains a first set of internal threads 14 for attaching to threads 12 of bottle 10.

The second brush system 30 contains a second cap 32 connected to second rod 34 and contains a second set of bristles 36 at the opposite end from second cap 32. Second rod 34 has a smaller diameter than that of first rod 24. This allows for second rod 34 to easily slide through first rod 24. Additionally, second rod 34 is of a length that allows the first set of bristles 26 and second set of bristles 36 to align with one another.

Figure 3:
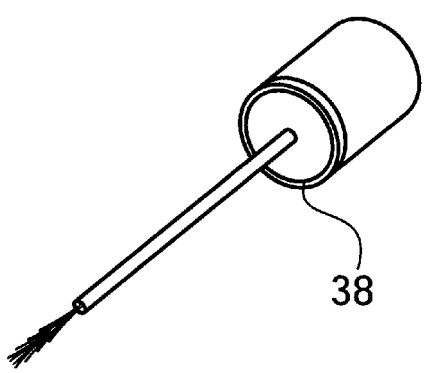
FIG. 3 shows a perspective view of the attachment of the dual brush system.
Figure 3:
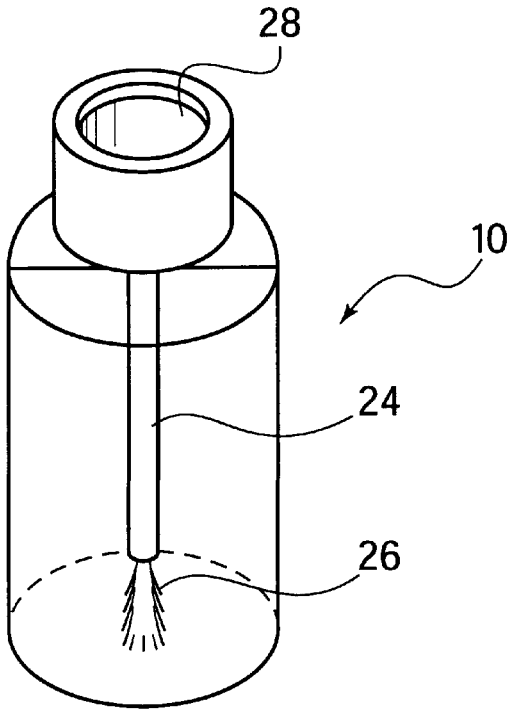

FIG. 3 shows second brush system 30 attaching to first brush system 20 by a second set of internal threads 28 in cannulated cap 22 and external threads 38 on second cap 32. However, second cap 32 could attach to cannulated cap 22 by another mechanism, such as snap-on cap.

In operation, second brush system 30 slides into first brush system 20 such that they are coaxially aligned with one another. Second rod 34 extends throughout cannulated rod 24 so that first set of bristles 26 and second set of bristles 36 combine and are coaxially aligned with one another. Therefore, both sets of bristles are used together. If a smaller diameter brush is needed, second brush system 30 can be separated from first brush system 20 by detaching second cap 32 from cannulated cap 22.

Since second rod 34 travels through first rod 24 there may be a tendency for the fluid contained in bottle 10 to dry up and clog the passageway in first rod 24. Therefore, it is advantageous to have first rod made of or coated with a material such as TEFLON®, to resist this build up.

Figure 4D:
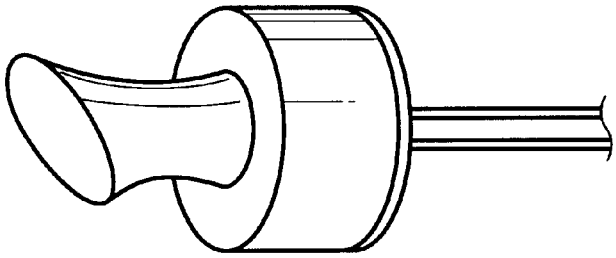
FIGS. 4*a* –4*d* show perspective views of various embodiments for the second cap of the dual brush system.
Figure 4C:
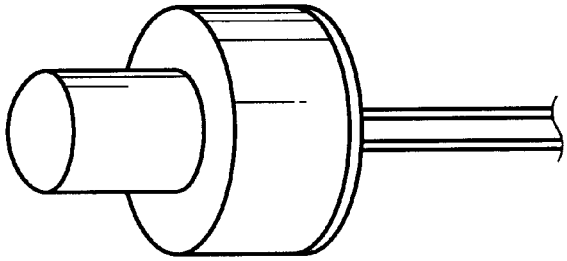
Figure 4B:
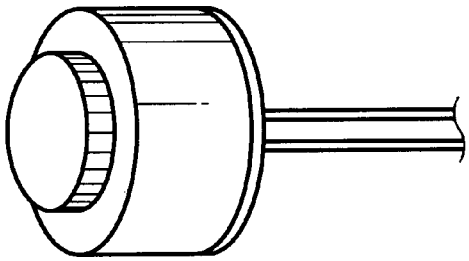
Figure 4A:
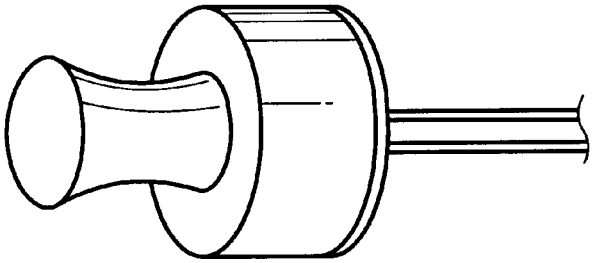

FIGS. 4*a*, 4*b*, 4*c*, and 4*d* show various embodiments of second cap 32. FIG. 4*a* shows second cap 32 having an hour glass shape. FIG. 4*b* shows second cap 32 having a flat oval shape. FIG. 4*c* shows second cap 32 having an angled hourglass shape. FIG. 4*d* shows second cap 32 having a oval shape. Each embodiment having a different ergonomic effect, depending on the needs of the user.

This brush system is advantageous when different brush sizes are needed to effectively perform a task. For instance, painting touch ups, nail polishing or applying cosmetics. This dual brush system provides the user with a diverse choice of brush sizes for various needs. The larger dual brush can be used for larger surface areas, wherein the smaller brush can be used for tighter, harder to reach surface areas.

Accordingly, while only a few embodiments of the present invention have been shown and described, it is obvious that many changes and modifications may be made thereunto without departing from the spirit and scope of the invention.

What is claimed is:

1. A dual brush system for a bottle comprising:

a first brush system comprising:

a cannulated cap;

a cannulated rod having a first end and a second end, said second end being attached to said cannulated cap; and a first set of bristles attached to said first end of said cannulated rod;

a second brush system comprising:

a second cap that attaches to said cannulated cap;

a second rod having a first end and a second end, said second end being attached to said second cap, and said second rod extending through said cannulated rod; and a second set of bristles attached to said first end of said second rod and disposed coaxially with said first set of bristles such that said first set of bristles and said second set of bristles are used simultaneously;

wherein said first brush system and said second brush system are coaxially aligned with one another and are used together as one large brush or said second brush system is used individually.

2. The dual brush system according to claim 1, wherein said cannulated cap comprises a first set of internal threads for attaching said second cap thereto.

3. The dual brush system according to claim 2, wherein said cannulated cap further comprises a second set of internal threads for attaching to the bottle.

4. The dual brush system according to claim 1, wherein said second cap comprises external threads for attaching to said cannulated cap.

5. The dual brush system according to claim 1, wherein said second cap is oval in shape.

6. The dual brush system according to claim 1, wherein said second cap has an hourglass shape.

7. The dual brush system according to claim 1, wherein said second cap has a flat oval shape.

8. The dual brush system according to claim 1, wherein said cap has an angled hourglass shape.

* * * * *